US008033289B2

(12) United States Patent
Buckley

(10) Patent No.: US 8,033,289 B2
(45) Date of Patent: Oct. 11, 2011

(54) ADJUSTABLE TARPAULIN SUPPORT

(76) Inventor: Scott L. Buckley, Seekonk, MA (US)

( * ) Notice: Subject to any disclaimer, the term of this patent is extended or adjusted under 35 U.S.C. 154(b) by 0 days.

(21) Appl. No.: 11/935,309

(22) Filed: Nov. 5, 2007

(65) Prior Publication Data

US 2009/0025769 A1 Jan. 29, 2009

Related U.S. Application Data

(63) Continuation-in-part of application No. 11/678,514, filed on Feb. 23, 2007, which is a continuation of application No. 11/096,122, filed on Apr. 1, 2005.

(60) Provisional application No. 60/961,822, filed on Jul. 23, 2007.

(51) Int. Cl.
*E04H 15/46* (2006.01)
*E04H 15/48* (2006.01)

(52) U.S. Cl. ..... 135/140; 135/142; 135/114

(58) Field of Classification Search ..... 135/139–143; 403/53, 54, 55, 58
See application file for complete search history.

(56) References Cited

U.S. PATENT DOCUMENTS

| | | | | | |
|---|---|---|---|---|---|
| 2,928,405 | A | | 3/1960 | Lawson | |
| 3,106,931 | A | | 10/1963 | Cooper | |
| 3,347,575 | A | | 10/1967 | Morris | |
| 4,529,331 | A | * | 7/1985 | Schwartz | 403/73 |
| 4,926,892 | A | | 5/1990 | Osmonson et al. | |
| 4,974,621 | A | | 12/1990 | Lerma | |
| 5,167,246 | A | * | 12/1992 | Mortenson | 135/153 |
| 5,255,698 | A | * | 10/1993 | Riley | 135/142 |
| 5,263,507 | A | | 11/1993 | Chuang | |
| 5,479,872 | A | | 1/1996 | Hulett | |
| D382,247 | S | | 8/1997 | Lindberg | |
| 5,697,320 | A | | 12/1997 | Murray | |
| 5,743,208 | A | | 4/1998 | Miller | |
| 6,026,761 | A | | 2/2000 | Parniske et al. | |
| 6,308,653 | B1 | | 10/2001 | Geraci | |
| 6,978,731 | B2 | * | 12/2005 | Erbetta | 114/361 |
| 2007/0144425 | A1 | * | 6/2007 | Buckley | 114/361 |
| 2009/0020147 | A1 | * | 1/2009 | Richard et al. | 135/122 |

FOREIGN PATENT DOCUMENTS

FR 2322 566 A1 4/1977

* cited by examiner

*Primary Examiner* — David Dunn
*Assistant Examiner* — Danielle Jackson
(74) *Attorney, Agent, or Firm* — Kunzler Needham Massey & Thorpe

(57) ABSTRACT

A support apparatus includes a rectilinear central pole having axially opposed end portions. The pole includes a plurality of oppositely spaced female portions and a male portion slid ably engageable therewith. Each female portion has a plurality of apertures equidistantly spaced along a longitudinal length thereof. The male portion is medially nested between the female portions wherein the female portions are telescopically movable. The apparatus further includes first and second pairs of telescopically adjustable and rectilinear leg members connected to the opposed end portions of the pole and extending away therefrom, respectively. The apparatus also includes a mechanism for independently pivoting each of the first and second leg members about a fulcrum axis centrally registered with the pole and extending parallel thereto. The apparatus also includes a mechanism for independently pivoting the first and second members along a unique arcuate path and about a fulcrum axis.

13 Claims, 16 Drawing Sheets

ADJUSTABLE TARPAULIN SUPPORT

CROSS-REFERENCE TO RELATED APPLICATIONS

This invention is a continuation-in-part application of and claims priority, under 35 U.S.C.§120, to: U.S. Non-Provisional patent application No. 11/678,514 to Scott L. Buckley filed on 23 Feb., 2007, which is a continuation application of and claims priority to U.S. Non-Provisional patent application No. 11/096,122 to Scott L. Buckley filed on 1 Apr., 2005; and U.S. Provisional Patent Application No. 60/961,822 to Scott L. Buckley filed on 23 Jul., 2007, each of which are incorporated by reference herein.

FIELD OF THE INVENTION

This invention relates to boat covers and, more particularly, to supports for boat covers comprised of flexible sheets.

DESCRIPTION OF THE RELATED ART

Many boats do not have roofs, and as a result, the passenger compartments are open to the elements of rain, snow, and wind. When such open boats are not in use, they are often covered with flexible covers, often called tarpaulins or tarps. A problem associated with tarps is that water or snow often forms pools on the tarps. The pools of water on the tarps can put excessive pressure on the tarp and cause it to tear. The excessive weight may cause the tarp to be pulled from its supports and cause the tarp to collapse causing the pooled water or snow to enter the boat. In addition, after a rain or snow storm, and the boat user is planning to use the boat, the user may be required to remove large quantities of pooled water or snow before being able to remove the tarp and gain access to the boat. For these and other reasons, it would be desirable if a boat tarp could be supported in such a way as to prevent the pooling of water or snow on the tarp.

In an effort to prevent water or snow from pooling on a tarp, some people employ certain makeshift steps. For example, some people place the tarp over the boat and then climb under the tarp to place a vertically standing stick under the tarp. The vertically standing stick supports a portion of the tarp at an elevated position so that the tarp slopes downward from the elevated position. Water or snow readily slides down the sloping tarp and does not form undesirable pools. A disadvantage of this method of tarp support is the necessity of climbing under the tarp. In this respect, it would be desirable if a device were provided for supporting a portion of a tarp in an elevated position without requiring a person to get under the tarp to install the tarp support.

Still other features would be desirable in a support apparatus for a flexible sheet boat cover. For example, in many boats, the most elevated point in the boat is present at the top of the windshield. In this respect, it would be desirable if the top of the windshield could be utilized in a tarp support apparatus.

When a tarp support is supporting a tarp, the weight of the tarp and the tarp support is born by the boat. In order not to damage portions of the boat that support the tarp support and tarp, it would be desirable if resilient pads could be provided between the tarp support and the boat. In the front portions of some boats, there are railings that are present that converge toward the bow of the boat. Under certain circumstances, it may be desirable is a tarp support could be supported by those converging railings.

Accordingly, a need remains for a tarpaulin cover support apparatus for boats that overcomes the above-noted shortcomings. The present invention satisfies such a need by providing an adjustable tarpaulin support that directs moisture in the form of rain, sleet, and snow away from a boat, instead of collecting it and pooling it as conventional tarps do. Such an apparatus is ideal for boats and other objects that are stored outdoors for preventing the pooling of water, which may, over a period of time, cause rust, mildew, or dry-rotting of a boat.

BRIEF SUMMARY OF THE INVENTION

In view of the foregoing background, it is therefore an object of the present invention to provide an adjustable tarpaulin support apparatus for providing cover for boats when in storage. These and other objects, features, and advantages of the invention are provided by an apparatus that may include a horizontally registered and/or rectilinear central pole having axially opposed end portions. The pole may include a plurality of oppositely spaced female portions and/or a male portion slid ably engageable therewith a mechanism to lock male and female portions at a desired position such that the overall length can be telescopically adjusted and fixed as desired.

The apparatus may further include first and/or second pairs of telescopically adjustable and/or rectilinear leg members connected to the opposed end portions of the pole and/or extending away therefrom respectively. Each first and/or second pairs of leg members may include first and/or second members respectively.

The apparatus may additionally include a mechanism for independently pivoting the first and/or second pairs of leg members about a fulcrum axis centrally registered with the pole and/or extending parallel thereto. Each member may be pivotal along independent arcuate paths radially extending outwardly from the pole wherein the leg member pair pivoting mechanism cooperates with the member pivoting mechanism in such a manner that a user may adapt each member while simultaneously rotating the pair of leg members during operating conditions.

The apparatus may also include a mechanism for independently pivoting each of the leg members along a unique arcuate path and/or about a fulcrum axis extending orthogonal to a longitudinal length of the pole in such a manner that each leg member may be independently positioned parallel and/or orthogonal to the pole.

The leg member pair pivoting mechanism may include a ball joint and/or first and/or second pairs of brackets rotatably connected to the end portions of the pole. First and/or second latches are operably conjoinable with the first and second pairs of brackets for locking the first and/or second pairs of brackets at biased positions respectively. The member pivoting mechanism may include third and/or forth pairs of brackets rotatably connected to the first and/or second pairs of brackets and/or securely connected to the members respectively.

Each of the leg members may be coextensive and/or include a female member portion connected to the member pivoting mechanism and/or extending away there from. A male member portion may be telescopically insertable into the female member portion and/or slidable between extended and/or retracted positions with a mechanism to lock male and female portions at a desired position such that the overall length can be adjusted and fixed as desired.

It is noted the purpose of the forgoing summary is to enable the U.S. Patent and Trademark Office and the public generally, specially the scientists, engineers and practitioners in the art who are not familiar with patent or legal terms or phraseology, to determine quickly from a cursory inspection the nature and essence of the technical disclosure of the application. The summary is neither intended to define the invention of the application, which is measured by the claims, nor is it intended to be limiting as to scope of the invention in any way.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
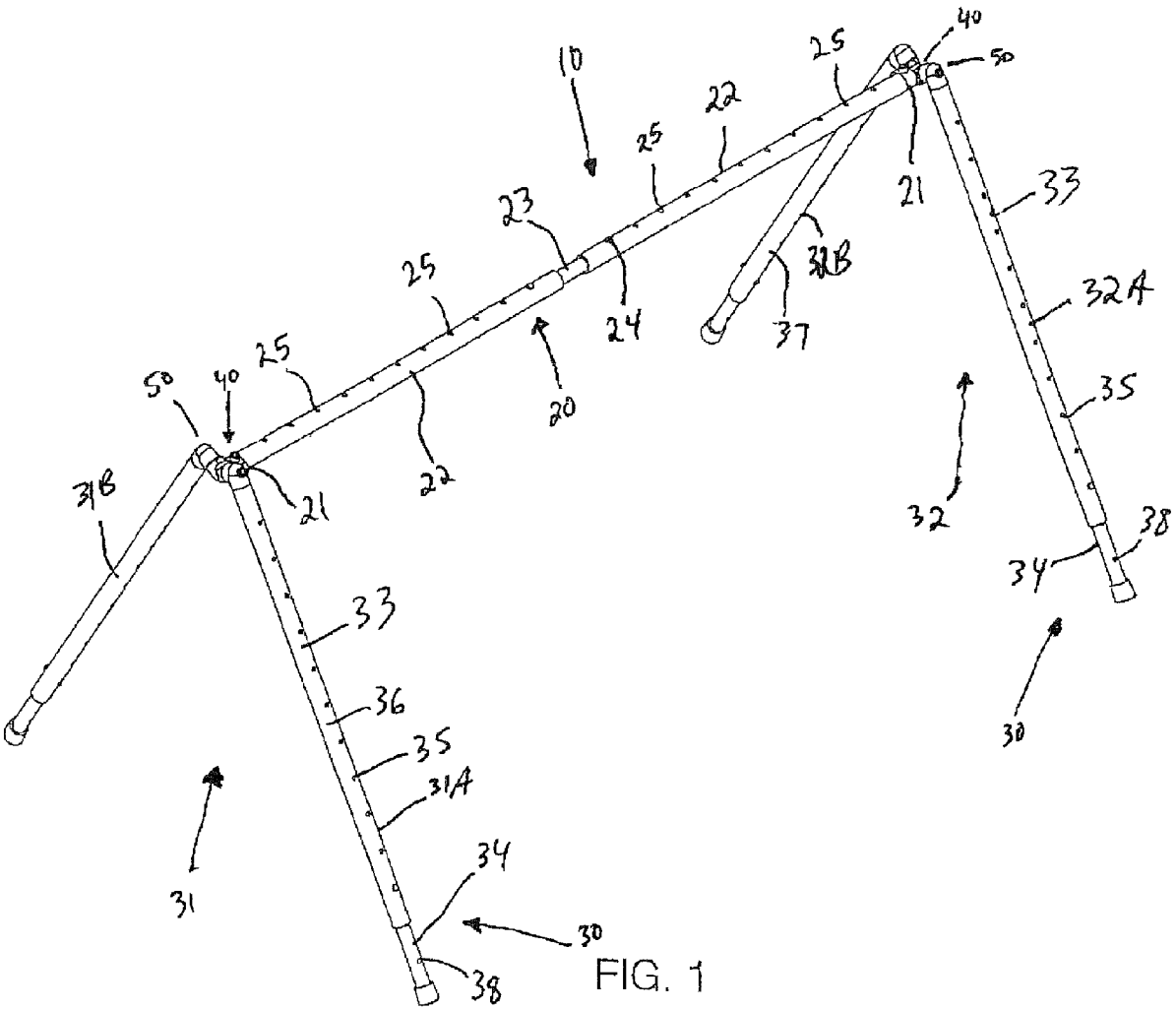
FIG. 1 is a perspective view of an adjustable tarpaulin support apparatus, according to one embodiment of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

One embodiment of this apparatus is referred to generally in FIGS. 1-6 by the reference numeral 10 and is intended to provide an adjustable tarpaulin support apparatus for providing cover for boats when in storage. It should be understood that the apparatus 10 may be used to cover and protect many different types of objects and should not be limited to use only with boats.

Figure 2:
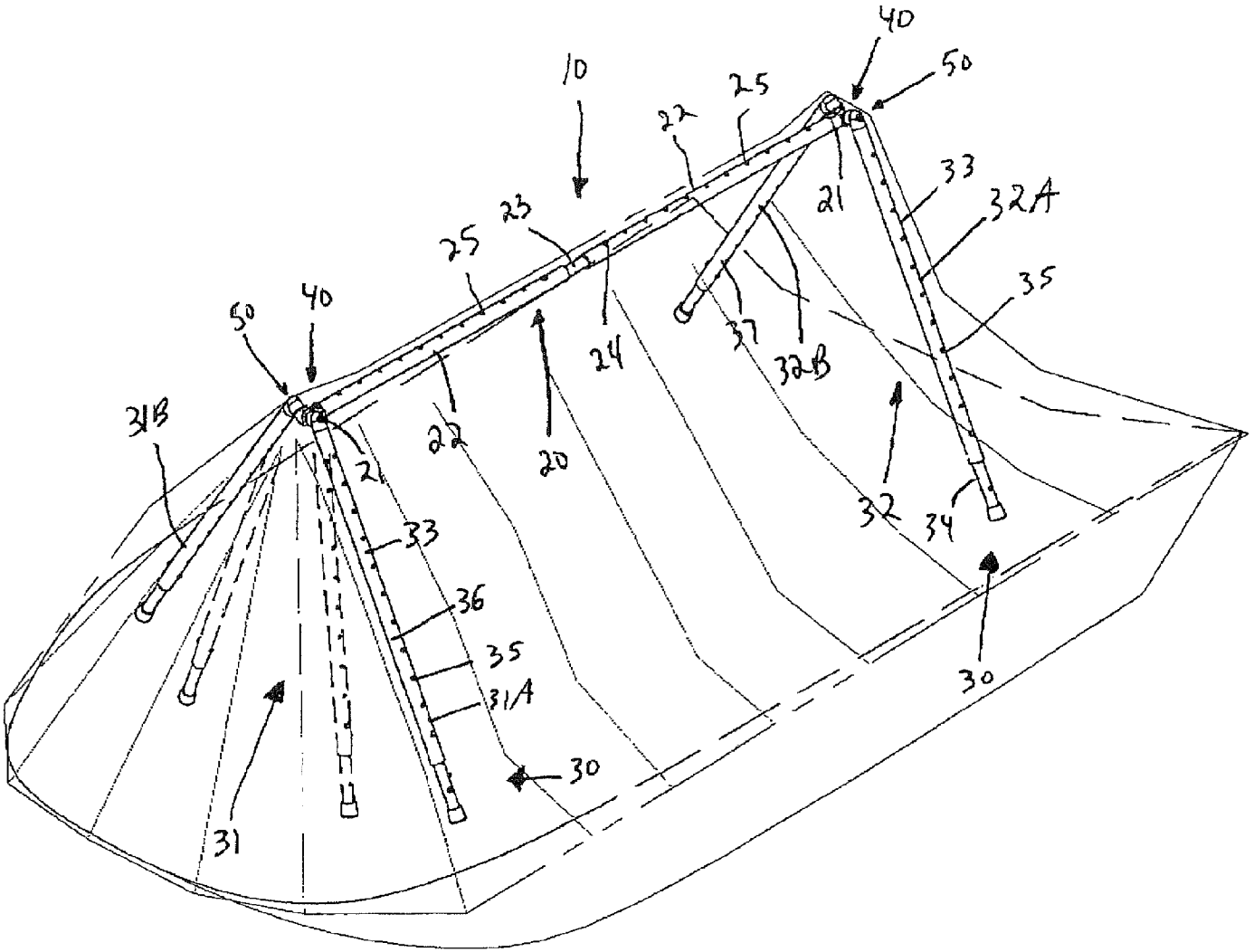
FIG. 2 is a perspective view of an adjustable tarpaulin support apparatus showing a tarpaulin covering the apparatus, according to one embodiment of the invention.

Initially referring to FIGS. 1 and 2, the apparatus 10 includes a horizontally registered and rectilinear central pole 20 having axially opposed end portions 21. The pole 20 includes a plurality of oppositely spaced female portions 22 and a male portion 23 slidably engageable therewith. Each female portion 22 preferably has a plurality of apertures 25 equidistantly spaced along a longitudinal length thereof for adjusting a length of the pole 20. The male portion 23 is medially nested between the female portions 22 wherein the female portions 22 are telescopically movable along a longitudinal length of the male portion 23 for axially adjusting a longitudinal length of the pole 20.

Figure 6:
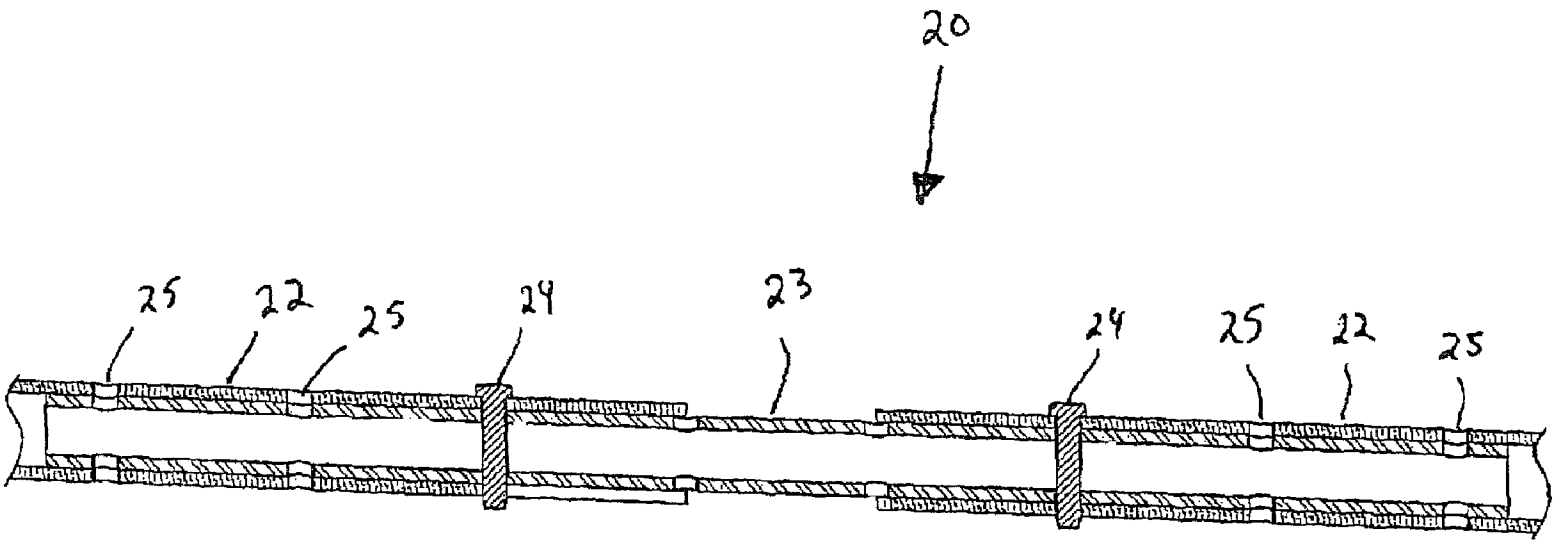
FIG. 6 is a cross-sectional view of the adjustable tarpaulin support apparatus, according to one embodiment of the invention.

The male portion 23 preferably has at least one detent 24 extending outwardly therefrom selectively insertable through one of the apertures 25 of the female portion 22, as shown in FIG. 6.

Figure 7:
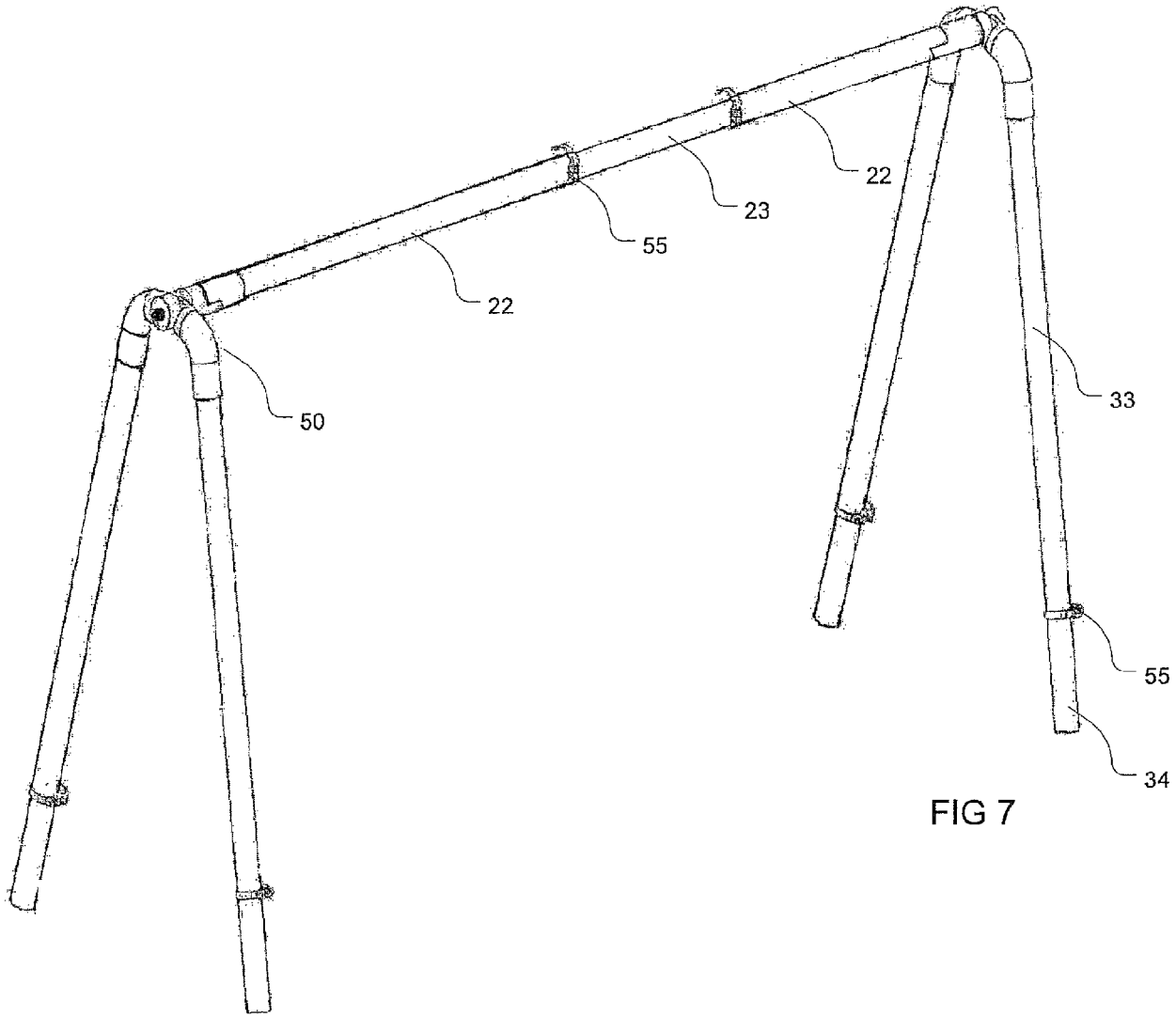
FIG. 7 is a view of the components of the adjustable tarpaulin support apparatus, according to one embodiment of the invention.

In another embodiment shown in FIG. 7, the male member 23 is telescopically insertable into the female member 22, is slidable between extended and retracted positions, and includes a locking mechanism 55 interfacing between member 23 and member 22. The locking mechanism allows for the adjustment of member 20 to any desired length by the user. Such a locking mechanism can function in a variety of well known methods such as a camlock or a twist lock fashion commonly understood to one skilled in the art.

Such an apparatus 10 is conveniently telescopically extendable along a linear length and height so the apparatus 10 can be adapted for use to cover objects of varying length and height. Such a feature allows the apparatus 10 to be adapted to fully support and accommodate any size tarpaulin in order to prevent sagging, stretching and tearing of the tarpaulin, while also keeping the covered object completely dry for the owner.

Referring to FIGS. 1 and 2, the apparatus 10 further includes first 31 and second 32 pairs of telescopically adjustable and rectilinear leg members 30 connected to the opposed end portions of the pole 20 and extending away therefrom respectively. Each first 31 and second 32 pairs of leg members 30 include first 31A, 32A and second 31B, 32B members respectively. In one embodiment of the invention, such leg members 30 and pole 20 are formed from aluminum because of its light weight and durability, but may also be formed from stainless steel, galvanized metal, or plastic, to resist corrosion in an outdoor environment. The apparatus 10 also includes a mechanism 50 for independently pivoting each of the members 30 along a unique arcuate path and about a fulcrum axis extending orthogonal to a longitudinal length of the pole 20 in such a manner that each leg member 30 can be independently positioned parallel and orthogonal to the pole 20, as shown in FIG. 2.

Figure 3:
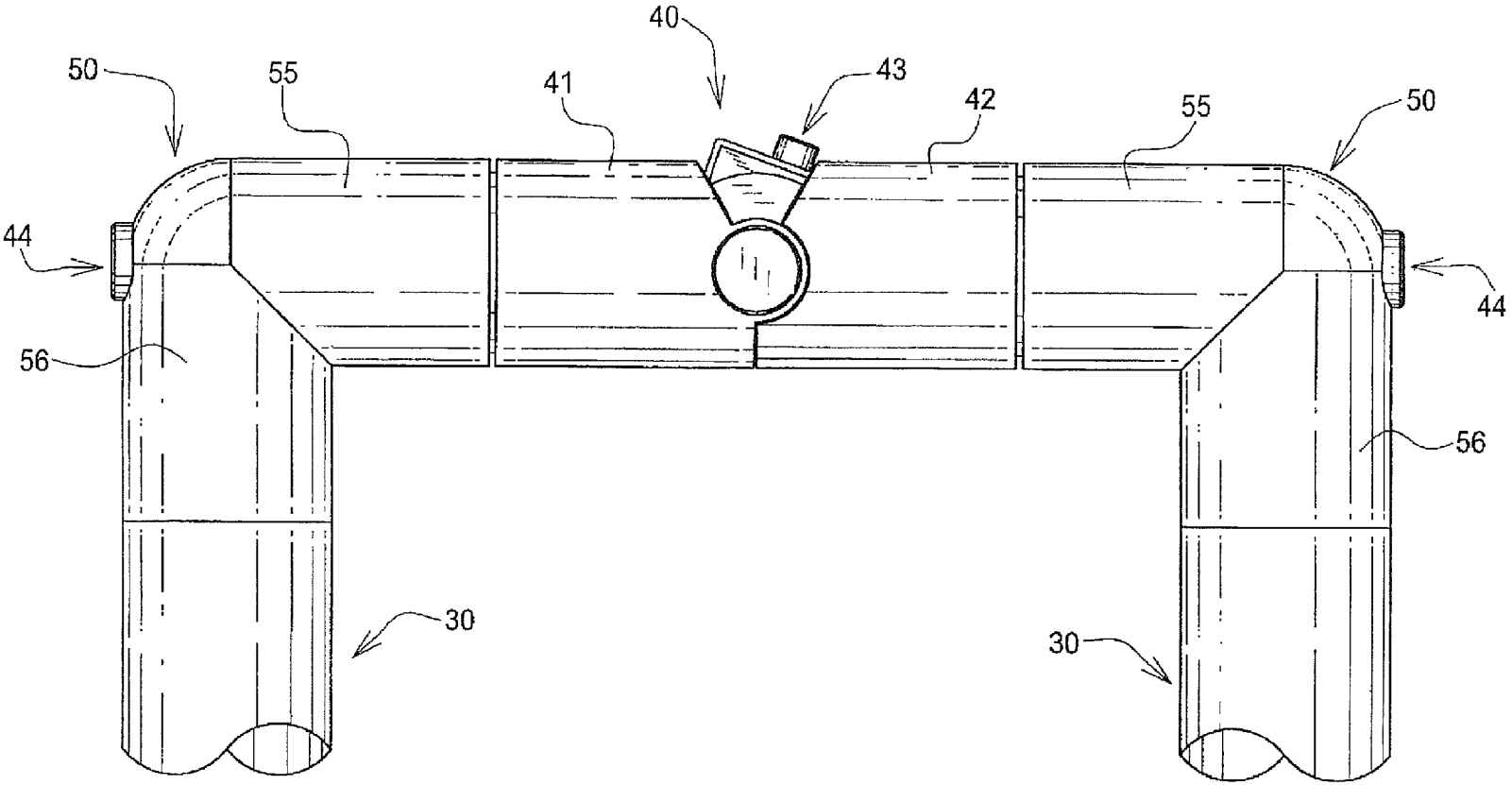
FIG. 3 is a side elevational view of a leg member pair pivoting mechanism, according to one embodiment of the invention.
Figure 3A:
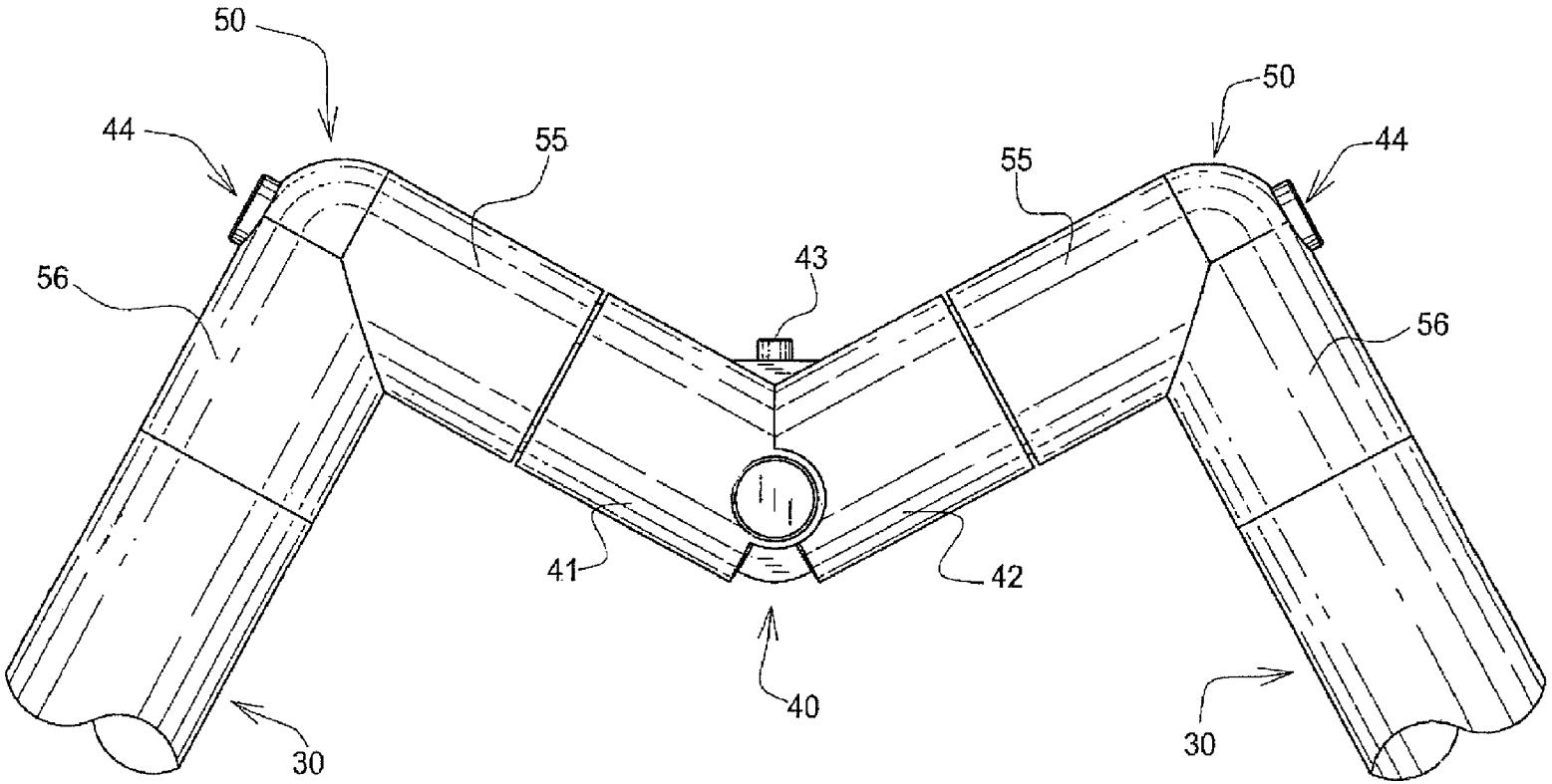
FIG. 3*a* is a side elevational view of a leg member pair pivoting mechanism, according to one embodiment of the invention.
Figure 4A:
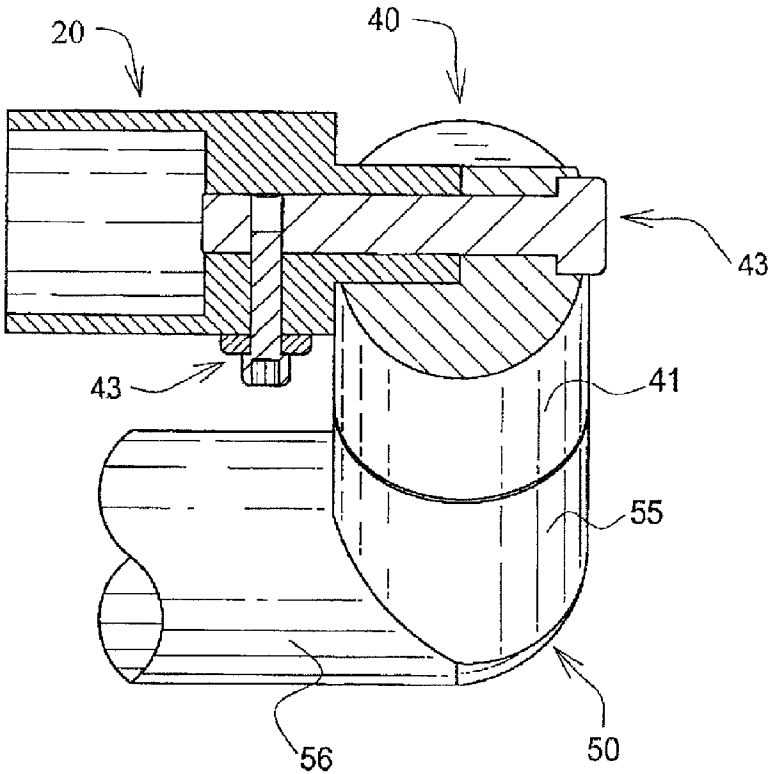
FIG. 4A is a cross-sectional view of the leg member pair pivoting mechanism of FIG. 4, according to one embodiment of the invention.
Figure 4:
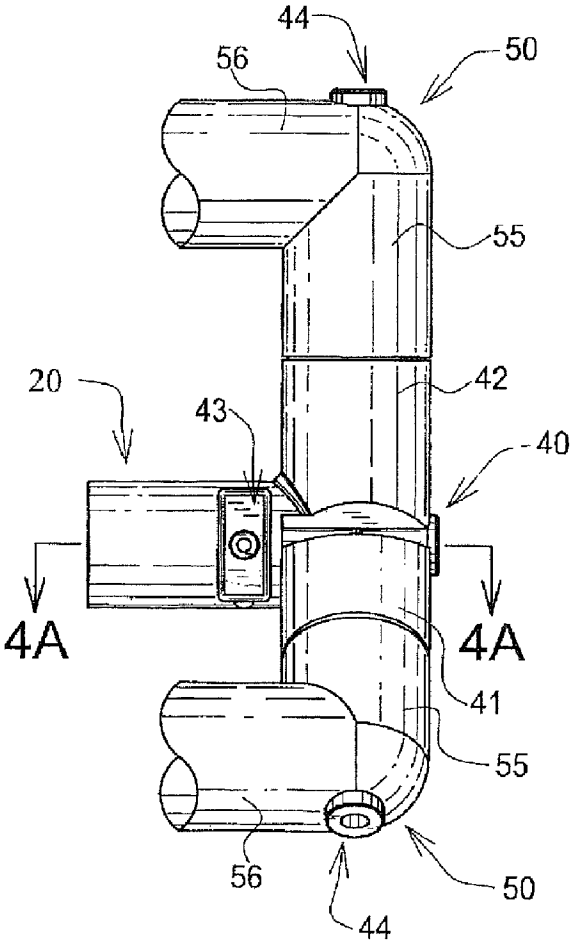
FIG. 4 is top plan view of a leg member pair pivoting mechanism, according to one embodiment of the invention.
Figure 4B:
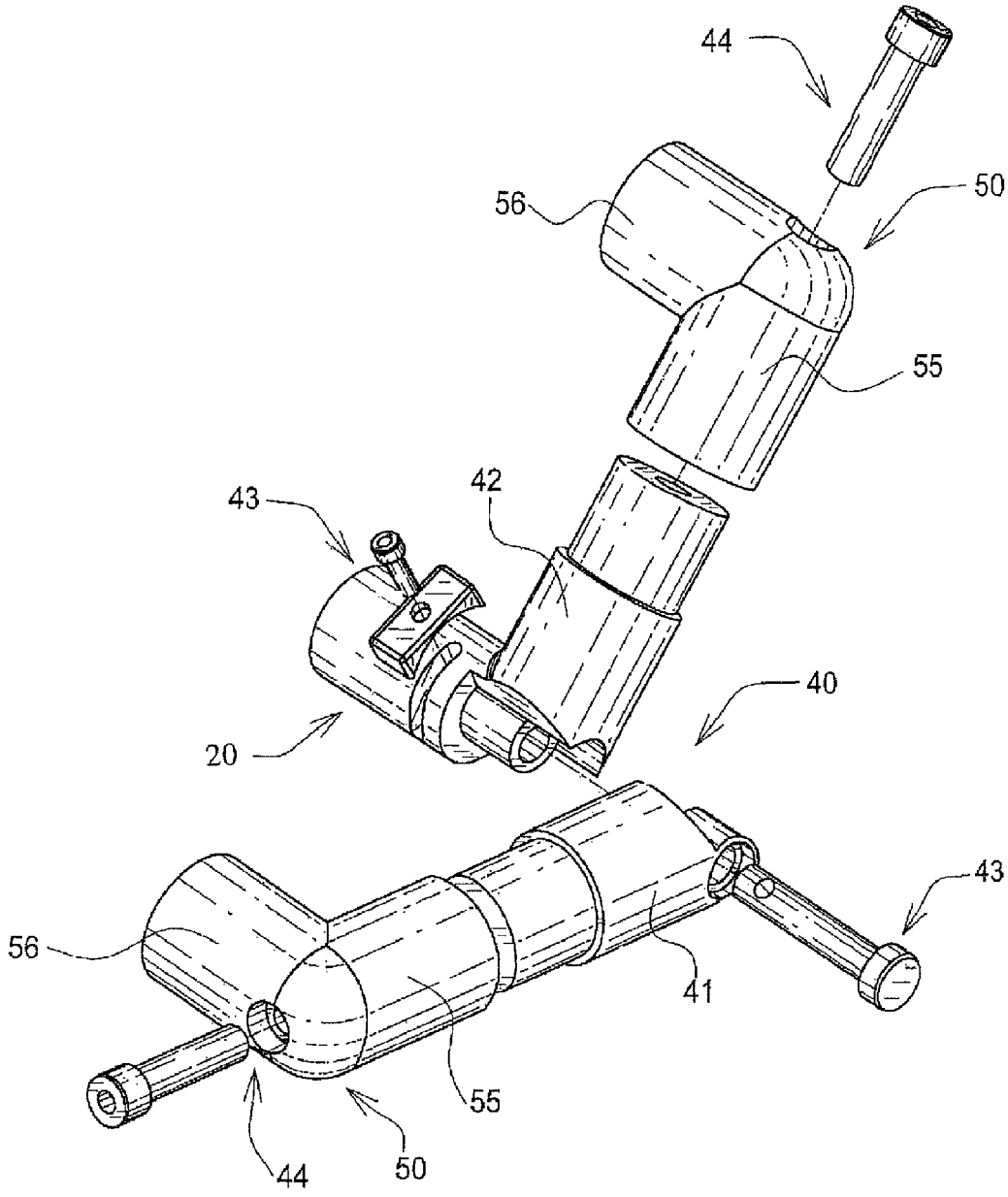
FIG. 4B is an exploded view of the leg member pair pivoting mechanism of FIG. 4, according to one embodiment of the invention.

Referring to FIGS. 3-4, the apparatus 10 also includes a mechanism 40 for independently pivoting the leg members 30 about a fulcrum axis centrally registered with the pole 20 and extending parallel thereto. Each member 30 is pivotal along independent arcuate paths radially extending outwardly from the pole 20 wherein the leg member pair pivoting mechanism 40 cooperates with the member pivoting mechanism 50 in such a manner that a user can adapt each member 30 while simultaneously rotating the pair of leg members 31, 32 during operating conditions.

Still referring to FIGS. 3-4, the leg member pair pivoting mechanism 40 includes first 41 and second 42 pairs of brackets rotatably connected to the end portions 21 of the pole 20, and a lock knob mechanism 43 operably conjoinable with the first 41 and second 42 pairs of brackets for locking the first 41 and second 42 pairs of brackets at biased positions, respectively. For example, one skilled in the art would appreciate that the lock knob 43 mechanism may be such as, but not limited to, the lock knob of U.S. Pat. No. 5,433,552, issued to Thyu, which is incorporated by reference herein. Advantageously, the lock knob mechanism 43 secures the first 41 and second 42 pairs of brackets, respectively, so that the apparatus may support a large amount of weight from rain, sleet, snow, and/or other environmental matter without collapsing.

Likewise, the member pivoting mechanism 50 includes third 55 and fourth 56 pairs of brackets rotatably connected to the first 41 and second 42 pairs of brackets and securely connected to the members 30, respectively. Further, the member pivoting mechanism 50 includes a pair of swivel locks 44. For example, one skilled in the art would appreciate that the pair of swivel locks 44 may be such as, but not limited to, a socket bolt. When placed inside a boat, the apparatus 10 may be adjusted to a desired length and height. Such a pivoting mechanism 50 provides folding and functionality of the apparatus 10 by allowing the apparatus 10 to be folded and conveniently stored.

Figure 8:
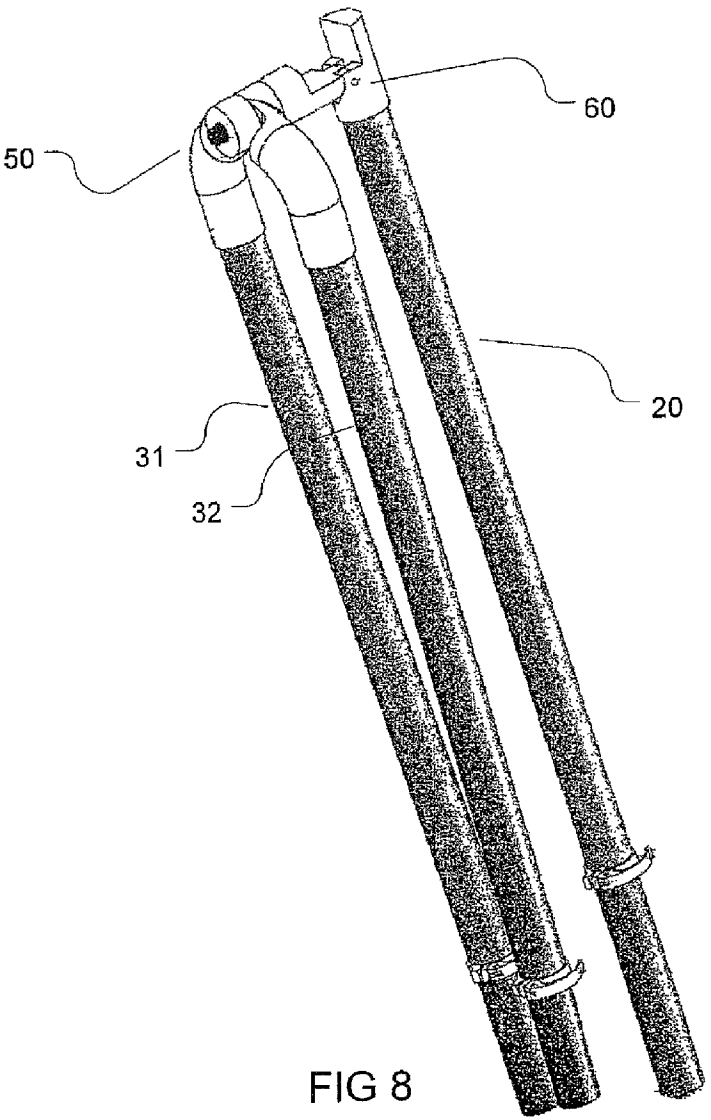
FIG. 8 is a view of the led pair components of the adjustable tarpaulin support apparatus, accordingly to one embodiment of the invention in a folded or collapsed position such as would be used for storage or transport of the apparatus.

In another embodiment shown in FIG. 8 the pivoting mechanism 50 includes a scissor type pivot for independently pivoting the leg members 30 about a fulcrum axis centrally registered with the pole 20 and extending orthogonal thereto. Such a pivot mechanism 50 also includes an independent hinge 60 joining leg member pairs 31 and 32 to the central pole 20, wherein leg member pairs 31 and 32 may be folded to a position parallel to the central pole 20 for compact storage.

Once adjusted and positioned with all four leg members 30 on a support platform, the apparatus 10 creates an A-frame configuration with the pole 20 for the support of a tarpaulin. Accordingly, during operating conditions, any rain, sleet, or snow rolls down all sides of the tarpaulin, preventing leakage or moisture seepage into the boat. Because the tarpaulin is not stretched or caused to sag by the accumulation of water, the material life of the tarpaulin is extended, resulting in less cost and inconvenience for the owner.

Referring back to FIGS. 1 and 2, each of the leg members 30 are coextensive and include a female member 33 portion connected to the member pivoting mechanism 50 and extending away therefrom. The female member 33 portion has a plurality of apertures 35 equidistantly spaced along a front 36 and rear 37 surface of the female member 33 portion. A male member 34 portion is telescopically insertable into the female member 33 portion and slidable between extended and retracted positions. Such a male member 34 portion has a plurality of equidistantly spaced apertures 38 selectively registerable with corresponding ones of the female members 33 portion apertures 35.

In another embodiment as shown in FIG. 7, the male member 34 portion is telescopically insertable into the female member 33 portion, is slidable between extended and retracted positions, and includes a locking mechanism 55 interfacing between member 34 and member 33. Such a locking mechanism allows for the adjustment of at any desired length by the user. Such a locking mechanism can function in a variety of well known methods such as a camlock or a twist lock commonly understood to one skilled in the art.

Figure 5:
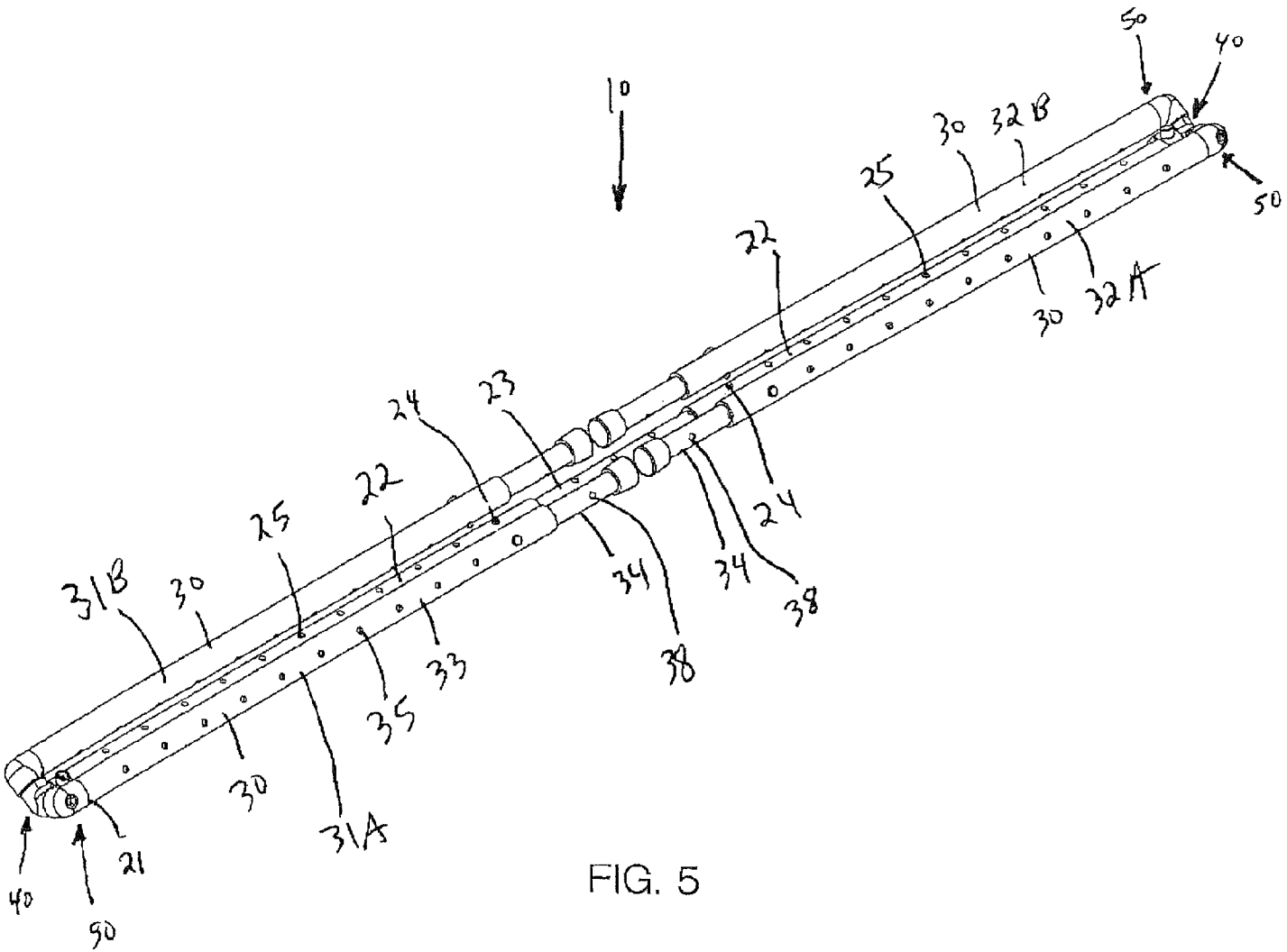
FIG. 5 is a perspective view of an adjustable tarpaulin support apparatus, in a folded or collapsed position according to one embodiment of the invention.

In one embodiment of the invention shown in FIG. 5, such members 33 have a longitudinal length equal to one-half the longitudinal length of the pole 20 so that the members 33 can be aligned end-to-end adjacent the pole 20 after being adapted to a folded position. In such a folded position, the apparatus 10 can be easily transported and stored, or used with another boat. The male members 34 preferably include a plurality of yieldable cups disposed subjacent a distal end portion of the male member 34. Such yieldable cups protect the male members from contaminants and moisture, and also prevent marring of a support surface and provide stability during operating conditions.

Figure 9:
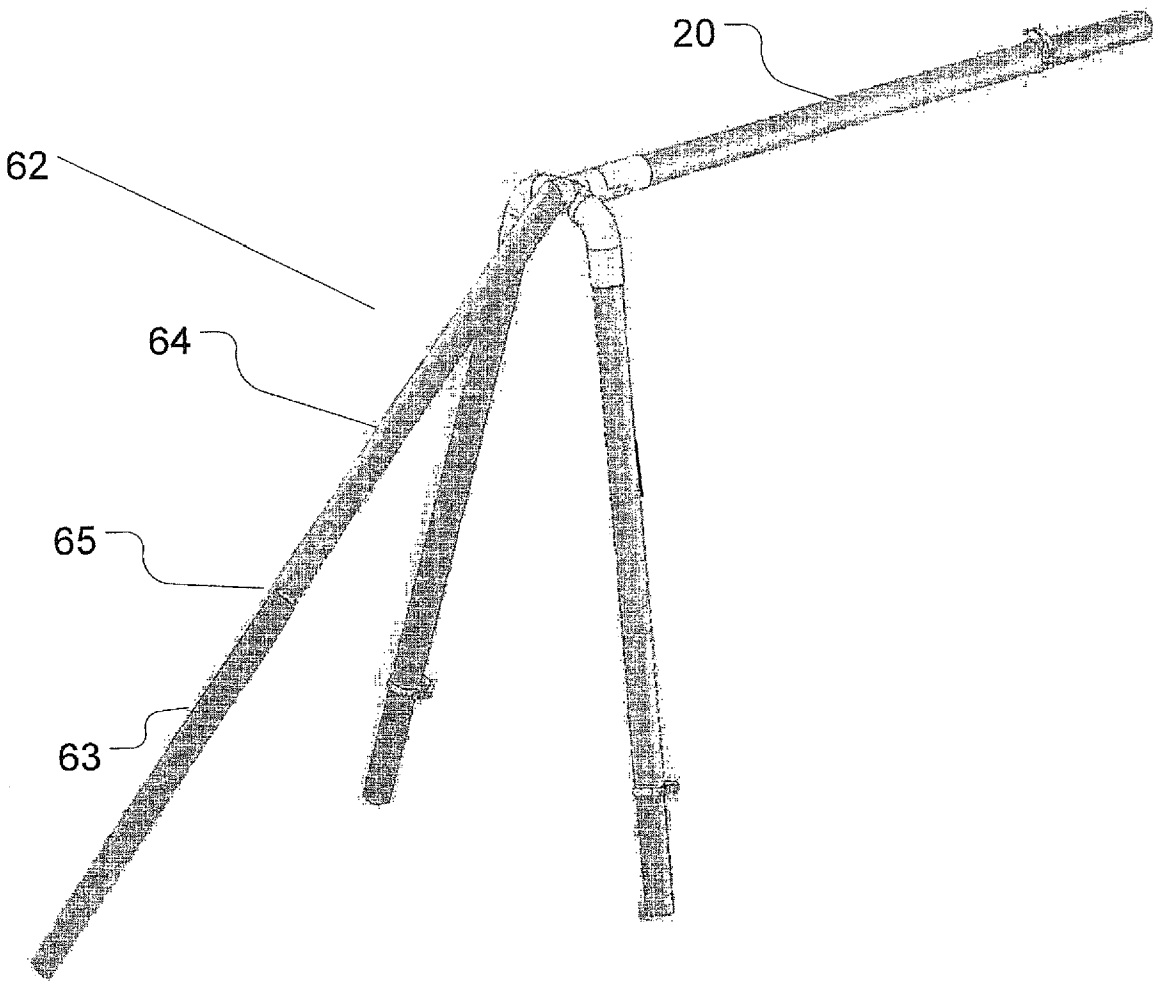
FIG. 9 is a view of the adjustable tarpaulin support apparatus with extension poles connected to the apparatus.

In another embodiment of the invention as shown in FIG. 9, the apparatus includes an extension pole 62 extending from one or both ends of the center pole 20. Such extension pole 62 is hinged in a pivotal fashion such that the extension pole can be projected in a direction that provides additional tangential support for the apparatus. The extension pole in one embodiment includes a male member 63 and a female member 64. The male member 63 is telescopically insertable into the female member 64 is slidable between extended and retracted positions, and includes a locking mechanism 65 interfacing between member 63 and member 64. The locking mechanism allows for the adjustment of member 62 to any desired length by the user. Such locking mechanism can function in a variety of well known methods such as a camlock or a twist lock commonly understood to one skilled in the art.

Figure 10:
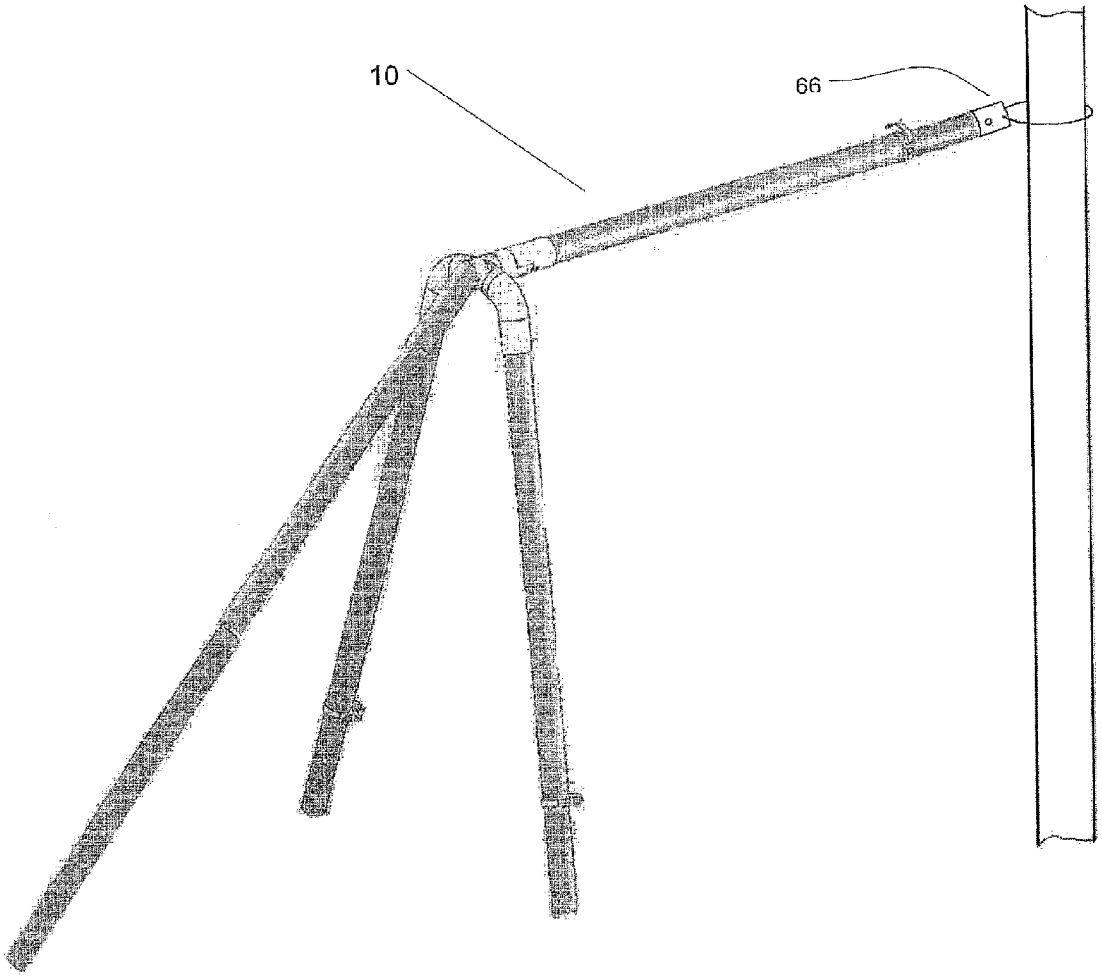
FIG. 10 is a view of the adjustable tarpaulin support apparatus, according to one embodiment.
Figure 11:
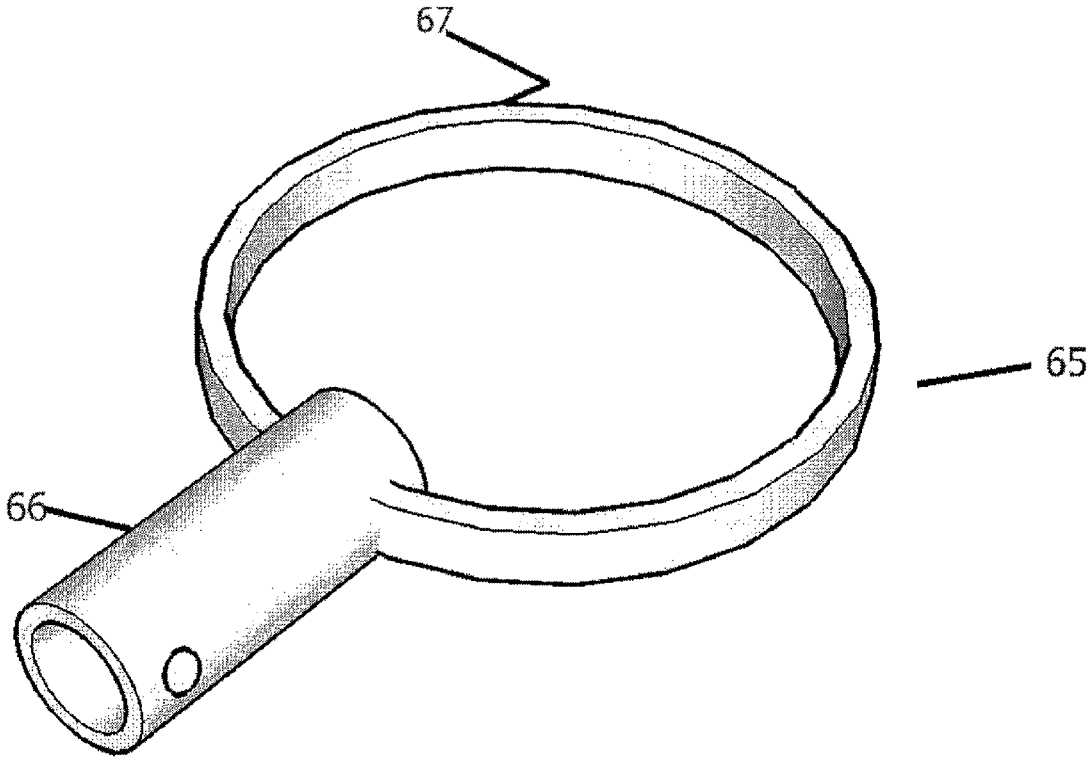
FIG. 11 is a view of the adjustable mechanism to the adjustable tarpaulin support apparatus, accordingly to one embodiment.

Under the embodiment of FIG. 10, the support structure 10 is separated in half at the midpoint of the central pole 20. Each half of the apparatus is supported at a separated midpoint by joining the separated half of the apparatus at a separated midpoint to an independent object such as the mast of a sailboat using a coupling device 66. In this manner, the support apparatus 10 can be used in an environment where there is a lack of open space for placement.

Figure 12:
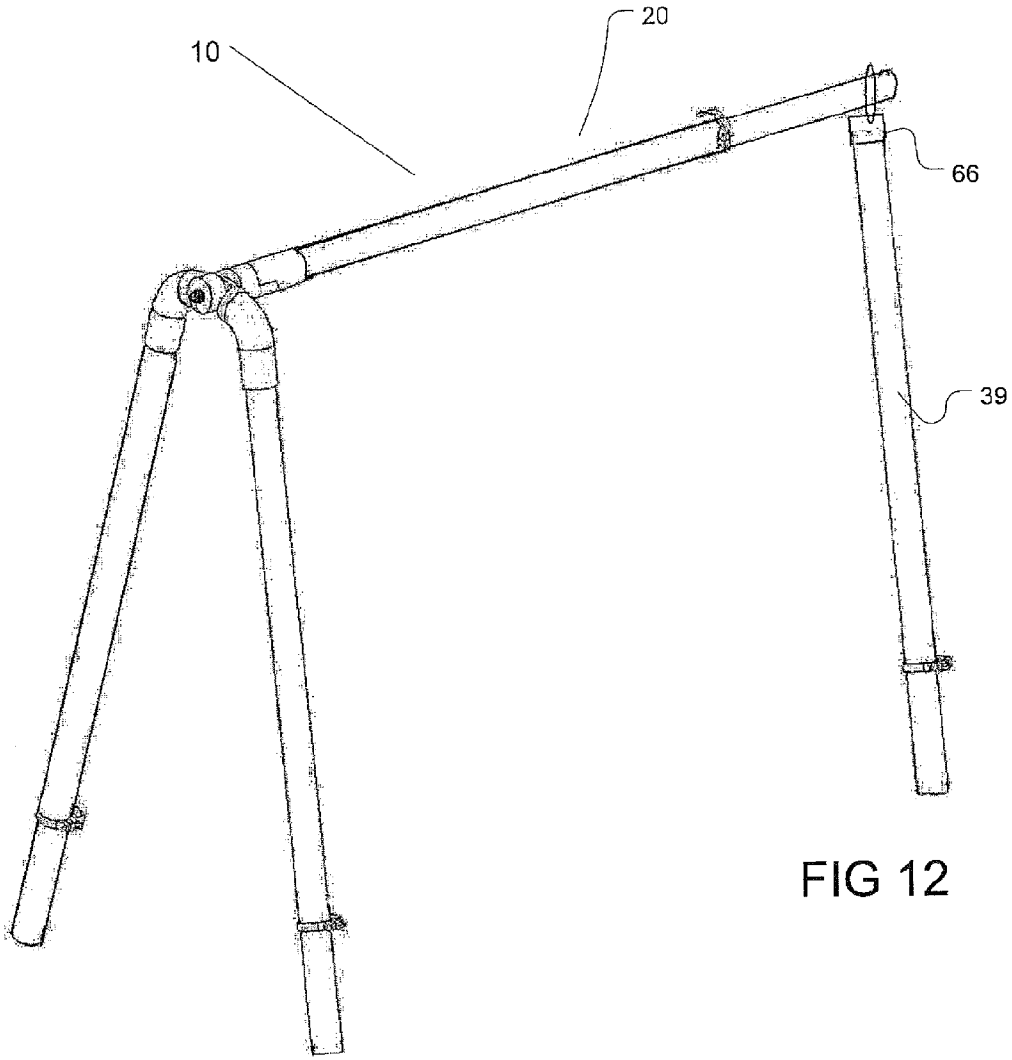
FIG. 12 is a view of the leg support to the adjustable tarpaulin support apparatus, accordingly to one embodiment.

In one embodiment shown in FIG. 12, the separated midpoint of the apparatus may be supported by an additional leg member 39 attached to the separated midpoint of the apparatus 10 with the use of a coupling 66 and extending to a support structure such as the floor or deck of a boat.

Figure 13:
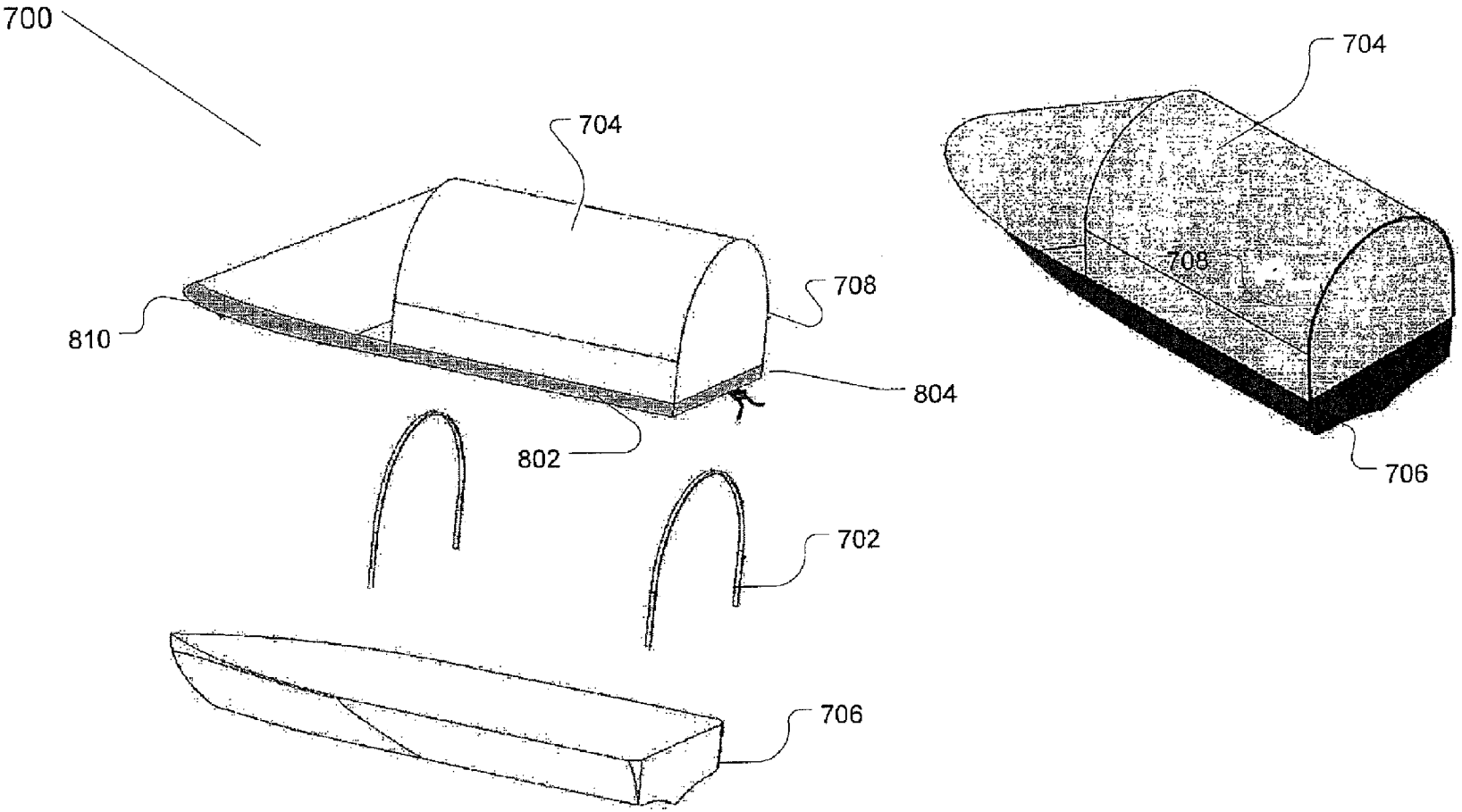
FIG. 13 is an exploded view of the adjustable tarpaulin support apparatus with the tarpaulin shown, according to one embodiment of the invention.

Under the embodiment of FIG. 13, the support structure for the slicker 704 consists of a plurality of flexible poles 702 of sufficient flexibility to be bent 180 degrees. When bent, these flexible poles 702 form a u-shape with a radius at the bend that is sufficient to allow the poles 702 to reach the opposite ends of the object to be covered. Under the embodiment of FIG. 14, the poles 702 reach the outer rim of the boat 706, across the shorter length of the boat 706. The distance between the poles 702 is changed according to the shape of the object to be protected.

Under the embodiment of FIG. 13, the flexible poles 702 are constructed of a material that has sufficient strength to retain a radiused bend with the force of the slicker 704 plus the addition of a plurality of elemental forces. In one embodiment, elemental forces include ice, snow, rain, sun radiation, leaves and animals. The poles 702 are constructed of a material that has a sufficient modulus of elasticity to retain the radiused bend and to be bent and straightened a plurality of times without fatigue failure. The poles 702 are constructed of a material that is corrosion resistant. In one embodiment, the poles 702 are constructed of a plastic composite material.

Under the embodiment of FIG. 13, the slicker 704 is equipped with a plurality of drawstrings 802. The drawstring 802 is contained within the outer edge 810 of the slicker 704 so that the slicker 704 constricts as the drawstring 802 is pulled. The drawstring 802 is held in its pulled state by a clasp mechanism 804 secured to the drawstring 802 near the position that the drawstring 802 enters the slicker 704. The clasp 804 is used to keep tension in the drawstring 802. The drawstring 802 and clasp mechanism 804 are used to secure the slicker 704 over the outer rim of the object to be covered. In one embodiment, the object to be covered has a lip that runs the perimeter of the object as in a boat. The drawstring 802 is loosed to put the slicker 704 over the entire perimeter of the object. Once the lip of the object is completely within the slicker 704, the drawstring 802 is pulled to constrict the slicker 704 around the perimeter of the object. This secures the slicker 704 on the object to prevent it from being removed and to maintain tension in the surface of the slicker 704. Under the embodiment of FIG. 13, it can be seen that tension is desired in the surface of the slicker 704 to insure that snow and rain and the like do not collect in low points in the slicker 704.

Figure 14:
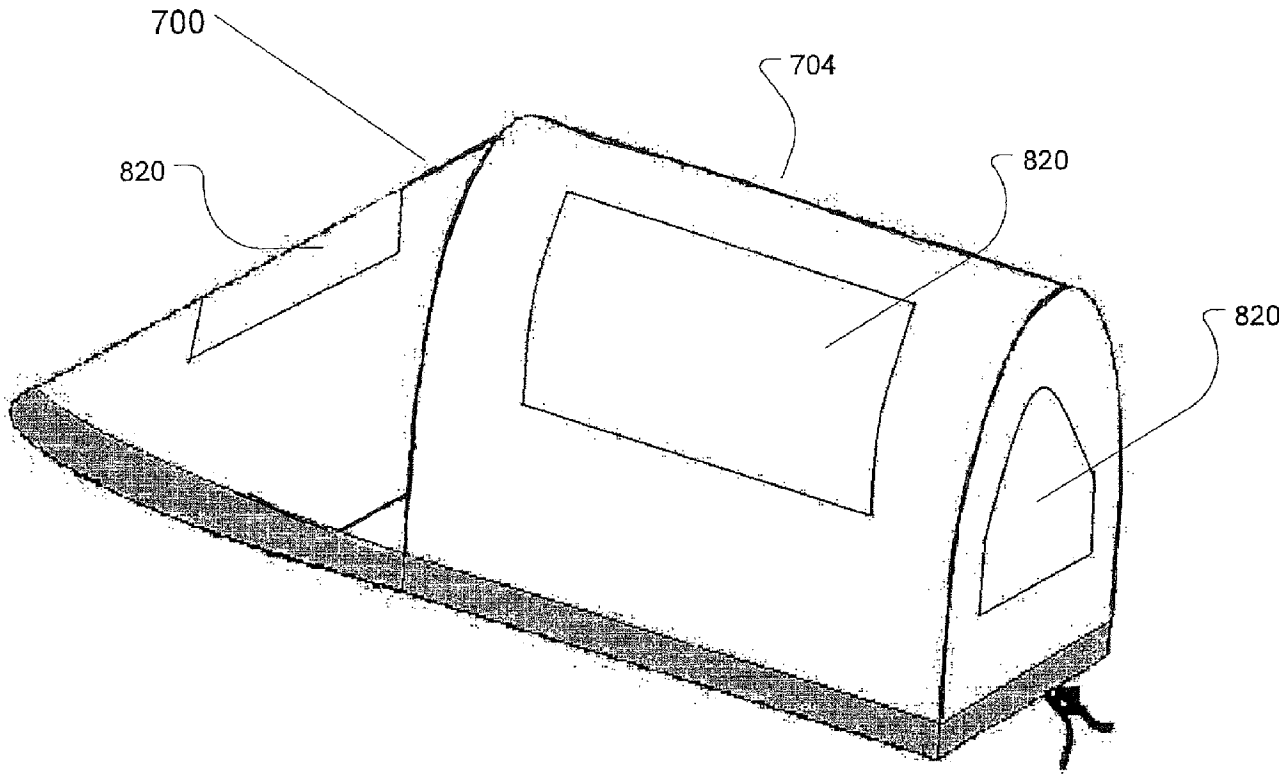
FIG. 14 is a view of the tarpaulin with added windows for visibility.

Under the embodiment of FIG. 14 the adjustable tarpaulin support 700 is equipped with a plurality of transparent panels 820 for viewable access into or out of the slicker. In this embodiment, the slicker can be used as a covering over a boat in inclement weather while the boat is in use.

There are several embodiments available to secure the slicker 704 to the flexible poles 702. In one embodiment, the flexible poles 702 are attached to the slicker 704 by a plurality of ties placed on the underside 812 of the slicker 704. The positioning of the ties corresponds to the desired positioning for the flexible poles 702. There is a plurality of ties for each flexible pole 702 to insure that the slicker 704 and the poles 702 are held together properly. In another embodiment, the slicker 704 is equipped with a plurality of fabric channels through which the flexible poles 702 are threaded. The fabric channels are attached to the slicker in the desired orientation for the flexible poles. In another embodiment, the slicker 704 is equipped with fabric tags attached to inside of the slicker 704. The male ends of the flexible poles 702 are inserted in the corresponding female holes in the tags to hold the flexible poles 702 in the flexed position. In this position, the flexible poles 702 put pressure on the inside of the slicker 704 which is held in the half cylinder shape 708. In another embodiment, the protected object is equipped with female receptors sized to receive the male ends of the flexible poles 702. When inserted, the flexible poles 702 are held in the flexed position creating a semi-circular arc 702. The slicker 704 is then placed over the flexible poles 702.

In one embodiment, the slicker 704 is not attached to the poles but is instead attached to the boat. The slicker 702 is attached to the boat using a plurality of buttons. The male portion of the button is on the boat while the female portion of the button is on the slicker 702. The buttons provide the force to produce tension in the slicker 704.

Under the embodiment of FIG. 13, the flexible poles 702 are shown in the unflexed position. The flexible poles 702 are stored in this position when not in use.

Under the embodiment of FIG. 13, the width adjustable belt 808 is shown attached to the bottom side of the slicker 704. The belt attaches to opposite sides of the slicker 704 near the position of the first flexible pole. In another embodiment, the belt 808 is attached near the center of the longer section of the slicker 704. The width adjustable belt is used to apply downward force to the slicker 704.

Under the embodiment of FIG. 13, a completed assembly of the adjustable tarpaulin support 700 is shown. The surface of the slicker 704 is in tension created by the flexible poles 702 and the attachment to the perimeter of the covered object. The tension in the surface of the slicker 704 centers on the high point of the slicker 704 created by the arc of the poles 702. This eliminates areas were water can collect on the slicker 704 and insures that all water will run off the slicker 704 and outside of the protected object.

Under the embodiment of FIG. 13, it can be seen that the slicker 704 and the orientation of the flexible poles 702 can be adjusted to accommodate the size and shape of the object to be covered. The slicker can be made to have the same shape as the object to be protected. Under the embodiment of FIG. 13, the non-cylindrical end of the slicker 704 is shaped to fit the perimeter of the boat.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. An adjustable tarpaulin support apparatus for providing cover to objects, comprising:

a horizontally registered central pole having axially opposed first and second end portions, wherein the pole is telescopically extendable;

a first locking mechanism for fixing a pole length of the central pole at a variably adjustable position;

a first pivot mechanism rotationally coupling a first pair of telescoping leg members to the first end portion of the pole, such that the first pair of telescoping leg members rotate outwardly about a fulcrum axis centrally registered with the central pole, each of the first pair of telescoping leg members having a first securing mechanism for maintaining a selected leg length;

a second pivot mechanism rotationally coupling a second pair of telescoping leg members to the second end portion of the pole, each of the second pair of telescoping leg members having a second securing mechanism for maintaining a selected leg length; and wherein the first and second pair of leg members pivot into a closed position wherein the first and second pairs of leg members are in a parallel configuration with respect to the central pole.

2. The adjustable tarpaulin support of claim 1 wherein the central pole includes a plurality of oppositely spaced female portions and a male portion slidably engageable with the female portions and medially disposed between the female portions, wherein the female portions are telescopically movable along a longitudinal length of the male portion.

3. The adjustable tarpaulin support of claim 1 wherein the central pole includes at least one pole extensions pivotally coupled to at least one of the first and second or both opposed end portions and extend outwardly therefrom.

4. The adjustable tarpaulin support of claim 1 wherein each of the leg members comprises:

a female member portion coupled to the member pivoting mechanism and extending outwardly therefrom, and a male member portion slidably coupled to an interior of the female member portion, having a locking mechanism disposed therein to fix the male and female member at a desired length.

5. The adjustable tarpaulin support of claim 4 wherein the members have a longitudinal length equal to one-half the longitudinal length of the central pole.

6. The adjustable tarpaulin support of claim 1, further comprising an extension member extending outward from one of the first and second end portions of the central pole, at an angle with respect to the central pole, the extension member comprising a first end portion coupling with the central pole and a second end portion coupling with a tarpaulin.

7. An adjustable tarpaulin support apparatus for providing cover to objects comprising:

a horizontally registered central pole having axially opposed first and second end portions, wherein the central pole is telescopically extendable, the central pole comprising a male portion disposed between and slidably engageable with a plurality of oppositely spaced female portions, wherein the female portions are telescopically movable along a longitudinal length of the male portion;

a locking mechanism for fixing a pole length of the central pole at a variably adjustable position;

a first pivot mechanism rotationally coupling a first pair of leg members to the first opposed end portion of the central pole, such that the first pair of telescoping leg members rotate outwardly about a fulcrum axis centrally registered with the central pole;

a second pivot mechanism rotationally coupling a second pair of leg members to the second opposed end portion of the central pole and extending outwardly therefrom; and wherein the first and second pairs of leg members pivot towards the fulcrum axis of the pole into a closed position wherein the first and second pairs of leg members are in a parallel configuration with respect to the central pole.

8. The adjustable tarpaulin support of claim 7 further comprising a leg member pair pivoting mechanism disposed between the first and second pairs of leg members and the horizontally registered central pole and configured to pivotally couple the first and second pairs of leg members to the opposed end portions of the pole, respectively, wherein the leg member pair pivoting mechanism includes a hinge.

9. The adjustable tarpaulin support of claim 8 wherein each of the first and second pairs of leg members is telescopically extendable.

10. The adjustable tarpaulin support of claim 9 wherein each of the first and second pairs of leg members comprises:

a female member portion coupled to the member pivoting mechanism and extending outwardly therefrom, having a plurality of apertures disposed along a front and rear surface of the female member portion; and a male member portion slidably coupled to an interior of the female member portion, having a plurality of apertures selectively registerable with corresponding apertures of the female member portions.

11. The adjustable tarpaulin support of claim 9 wherein each of the first and second pairs of leg members comprises:

a female member portion coupled to the member pivoting mechanism and extending outwardly therefrom, and a male member portion slidably coupled to an interior of the female member portion, having a compression locking mechanism disposed therein to fix the male and female member at a desired length.

12. The adjustable tarpaulin support of claim 9 wherein each of the first and second pairs of leg members have a longitudinal length equal to one-half the longitudinal length of the pole.

13. An apparatus comprising:

a horizontally registered central pole having axially opposed first and second end portions, wherein the central pole is telescopically extendable;

a first locking mechanism for fixing a pole length of the central pole at a variably adjustable position;

a first pivot mechanism rotationally coupling a first pair of telescoping leg members to the first end portion of the pole, such that the first pair of telescoping leg members rotate outwardly about a fulcrum axis centrally registered with the central pole, each of the first pair of telescoping leg members having a first securing mechanism for maintaining a selected leg length;

a second pivot mechanism rotationally coupling a second pair of telescoping leg members to the second end portion of the pole, each of the second pair of telescoping leg members having a second securing mechanism for maintaining a selected leg length;

wherein the first and second pair of leg members pivot into a closed position wherein the first and second pairs of leg members are in a parallel configuration with respect to the central pole; and an extension member extending outward from one of the first and second end portions of the central pole, at an angle with respect to the central pole, the extension member comprising a first end portion coupling with the central pole and a second end portion coupling with a tarpaulin.

* * * * *